US010429048B2

(12) United States Patent
Leijnse et al.

(10) Patent No.: US 10,429,048 B2
(45) Date of Patent: Oct. 1, 2019

(54) LED SOCKET FOR RECEIVING A COB-LED AND BASE FOR SUCH LED SOCKET

(71) Applicant: TE Connectivity Nederland BV, s'Hertogenbosch (NL)

(72) Inventors: Olaf Leijnse, Asten (NL); Peter Poorter, Wijk en Aalburg (NL)

(73) Assignee: TE Connectivity Nederland BV, S-Hertogenbosch (NL)

( * ) Notice: Subject to any disclaimer, the term of this patent is extended or adjusted under 35 U.S.C. 154(b) by 0 days.

(21) Appl. No.: 16/009,796

(22) Filed: Jun. 15, 2018

(65) Prior Publication Data

US 2018/0292075 A1 Oct. 11, 2018

Related U.S. Application Data

(63) Continuation of application No. PCT/EP2016/055461, filed on Mar. 14, 2016.

(30) Foreign Application Priority Data

Dec. 15, 2015 (EP) ..... 15200137

(51) Int. Cl.
*F21V 23/06* (2006.01)
*F21K 9/00* (2016.01)
(Continued)

(52) U.S. Cl.
CPC ..... *F21V 23/06* (2013.01); *F21K 9/00* (2013.01); *F21V 19/005* (2013.01);
(Continued)

(58) Field of Classification Search
CPC ... H01R 12/714; H01R 13/2478; F21V 23/06; F21V 19/005
(Continued)

(56) References Cited

U.S. PATENT DOCUMENTS 8,568,001 B2 * 10/2013 Daily ..... F21V 19/004 362/396
8,608,359 B2 * 12/2013 Kataoka ..... G02B 6/0086 362/23.09
(Continued)

FOREIGN PATENT DOCUMENTS

CN 102927456 A 2/2013
CN 103066449 A 4/2013
(Continued)

OTHER PUBLICATIONS

International Search Report and the Written Opinion of the International Searching Authority, dated Apr. 22, 2016, 13 pages.
(Continued)

*Primary Examiner* — Tulsidas C Patel
*Assistant Examiner* — Peter G Leigh
(74) *Attorney, Agent, or Firm* — Barley Snyder

(57) ABSTRACT

An LED socket comprises an LED package having an LED mounted on an LED printed circuit board, a contact having a receiving section adapted to be connected to a terminal end of an electrical cable and a contact lug having a T-shaped contact section, and a base defining a receptacle for receiving the LED printed circuit board. The receptacle is open to an opening in the base adapted to expose the LED at a front face of the base. The base holds the contact and the T-shaped contact section is exposed in the receptacle and electrically contacts a pad of the LED printed circuit board.

19 Claims, 9 Drawing Sheets

(51) Int. Cl.

| | |
|---|---|
| ***F21V 19/00*** | (2006.01) |
| ***H01R 12/53*** | (2011.01) |
| ***H01R 12/71*** | (2011.01) |
| ***H01R 13/24*** | (2006.01) |
| ***H01R 33/18*** | (2006.01) |
| *H01R 4/48* | (2006.01) |
| *F21Y 101/00* | (2016.01) |
| *F21Y 115/10* | (2016.01) |

(52) U.S. Cl.
CPC ..... *F21V 19/0055* (2013.01); *H01R 12/53* (2013.01); *H01R 12/714* (2013.01); *H01R 13/2478* (2013.01); *H01R 33/18* (2013.01); *F21Y 2101/00* (2013.01); *F21Y 2115/10* (2016.08); *H01R 4/4809* (2013.01)

(58) Field of Classification Search
USPC ..... 439/56
See application file for complete search history.

(56) References Cited

U.S. PATENT DOCUMENTS

| | | | | |
|---|---|---|---|---|
| 8,834,194 | B2 * | 9/2014 | Sakai | F21V 19/004 439/345 |
| 8,926,135 | B2 * | 1/2015 | Zaderej | F21K 9/00 362/249.05 |
| 9,494,303 | B2 | 11/2016 | McGowan et al. | |
| 2013/0065419 | A1 | 3/2013 | Sakai | |
| 2013/0077326 | A1 * | 3/2013 | Zantout | F21V 21/088 362/396 |
| 2013/0176732 | A1 | 7/2013 | McGowan et al. | |
| 2014/0268887 | A1 * | 9/2014 | Schroll | F21V 29/507 362/652 |
| 2015/0055356 | A1 * | 2/2015 | Derks | H01R 13/24 362/418 |
| 2015/0109801 | A1 * | 4/2015 | McGowan | H01R 4/4818 362/370 |
| 2015/0131301 | A1 * | 5/2015 | Ho | F21V 19/004 362/382 |

FOREIGN PATENT DOCUMENTS

| | | | |
|---|---|---|---|
| CN | 203202944 | U | 9/2013 |
| CN | 104051922 | A | 9/2014 |
| CN | 104350328 | A | 2/2015 |
| EP | 2570721 | A1 | 3/2013 |
| GB | 2247363 | A | 2/1992 |
| JP | 2012119523 | A | 6/2012 |
| JP | 201362148 | A | 4/2013 |
| WO | 2011088212 | A2 | 7/2011 |
| WO | 2013020773 | A | 2/2013 |
| WO | 2013020773 | A2 | 2/2013 |
| WO | 2013131090 | A1 | 9/2013 |
| WO | 2015021458 | A1 | 2/2015 |
| WO | 2015101420 | A1 | 7/2015 |
| WO | 2015106192 | A1 | 7/2015 |

OTHER PUBLICATIONS

Abstract of CN104051922A, dated Sep. 17, 2014, 2 pages.
European Communication, European Patent Application No. 15 200 137.6, dated Oct. 22, 2018, 6 pages.
Notice of Reasons for Refusal, dated Jul. 2, 2019, 22 pages.
Abstract of JP2012119523, dated Jun. 21, 2012, 1 page.
First Chinese Office Action and English translation, Appl No. 201680072833.6, dated Jul. 5, 2019, 23 pages.
Abstract of CN203202944, dated Sep. 18, 2013, 1 page.
Abstract of CN102927456, dated Feb. 13, 2013, 1 page.

* cited by examiner

LED SOCKET FOR RECEIVING A COB-LED AND BASE FOR SUCH LED SOCKET

CROSS-REFERENCE TO RELATED APPLICATIONS

This application is a continuation of PCT International Application No. PCT/EP2016/055461, filed on Mar. 14, 2016, which claims priority under 35 U.S.C. § 119 to European Patent Application No. 15200137.6, filed on Dec. 15, 2015.

FIELD OF THE INVENTION

The present invention relates to a socket and, more particularly, to a light emitting diode ("LED") socket.

BACKGROUND

An LED socket disclosed in U.S. Pat. No. 8,568,001 comprises a base which defines a receptacle for receiving an LED printed circuit board. An LED is mounted on the LED printed circuit board to form an LED package. The receptacle is open to an opening in the base adapted to expose the LED at a front face of the base. The base holds contacts, each of which have a receiving section adapted to be connected to a terminal end of an electrical cable. Each contact also has a contact lug adapted to electrically contact a pad of a printed circuit board.

In the lighting industry, there is a need for a low-cost, small sized holder for an LED. Such a low-cost holder is used for chip on board ("CoB") LEDs; a CoB-LED is provided with the printed circuit board as a unitary element which can be connected to an LED socket to allow the LED to be mechanically mounted in a lamp housing or the like and to be electrically connected to wiring for energizing the LED. CoB-LEDs have contact pads on their printed circuit board of different sizes and locations. It is difficult to use a holder to contact and mount a plurality of different CoB-LEDs having contact pads with different locations.

SUMMARY

An LED socket comprises an LED package having an LED mounted on an LED printed circuit board, a contact having a receiving section adapted to be connected to a terminal end of an electrical cable and a contact lug having a T-shaped contact section, and a base defining a receptacle for receiving the LED printed circuit board. The receptacle is open to an opening in the base adapted to expose the LED at a front face of the base. The base holds the contact and the T-shaped contact section is exposed in the receptacle and electrically contacts a pad of the LED printed circuit board.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
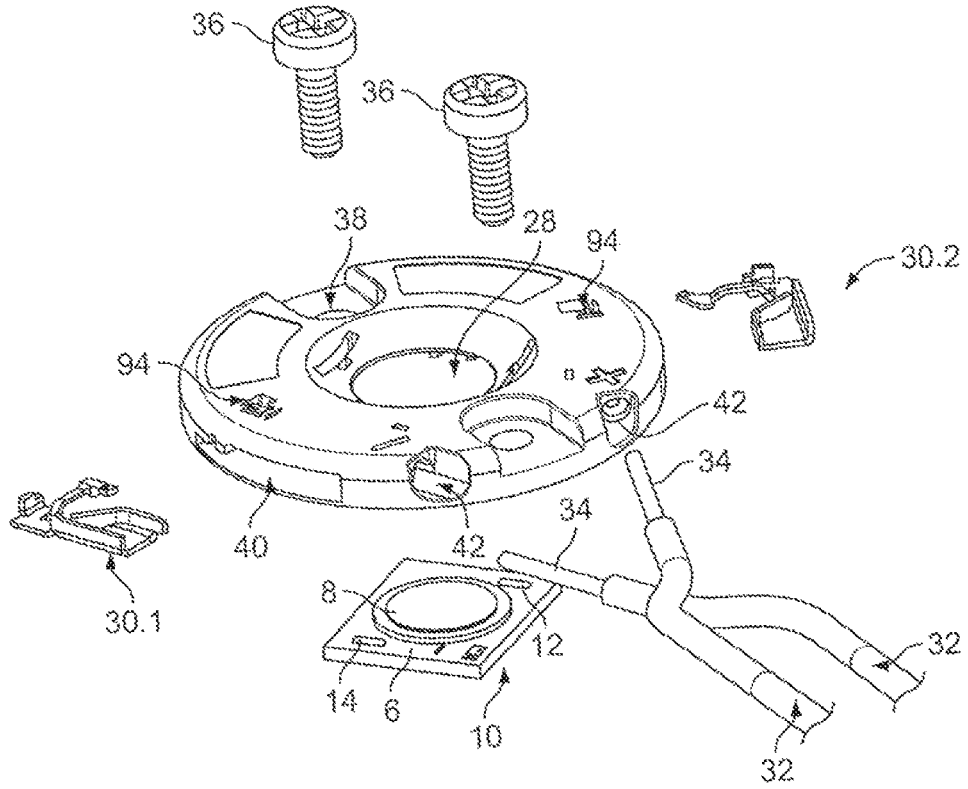
FIG. 1 is an exploded perspective front view of an LED socket according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

An LED socket according to an embodiment is shown in FIGS. 1-4. The LED socket includes a base 2, a light emitting diode ("LED") package 10 received in the base 2, and a plurality of contacts 30.1, 30.2 mounted in the base 2. Throughout the description, the contacts 30.1, 30.2 may alternatively be referred to collectively as contacts 30.

The LED package 10, as shown in FIG. 1, includes a printed circuit board (PCB) 6 supporting and electrically connected to an LED 8. The PCB 6 has two distinct pads 12, 14 provided on a surface supporting the LED 8.

Figure 2:
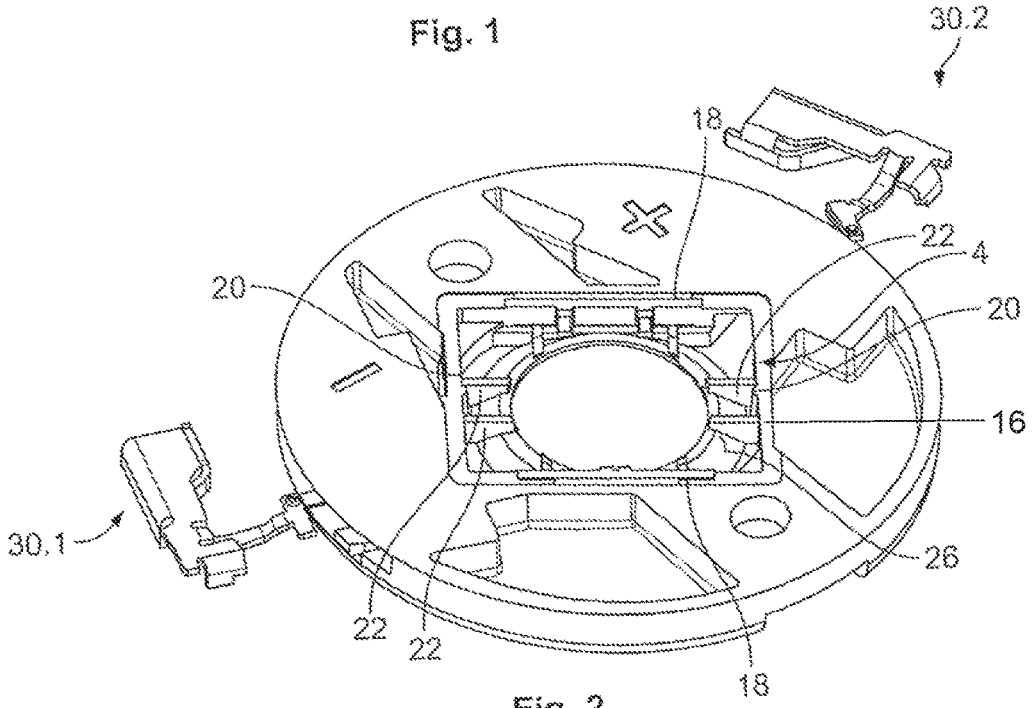
FIG. 2 is a perspective back view of a base and contacts of the LED socket.
Figure 3:
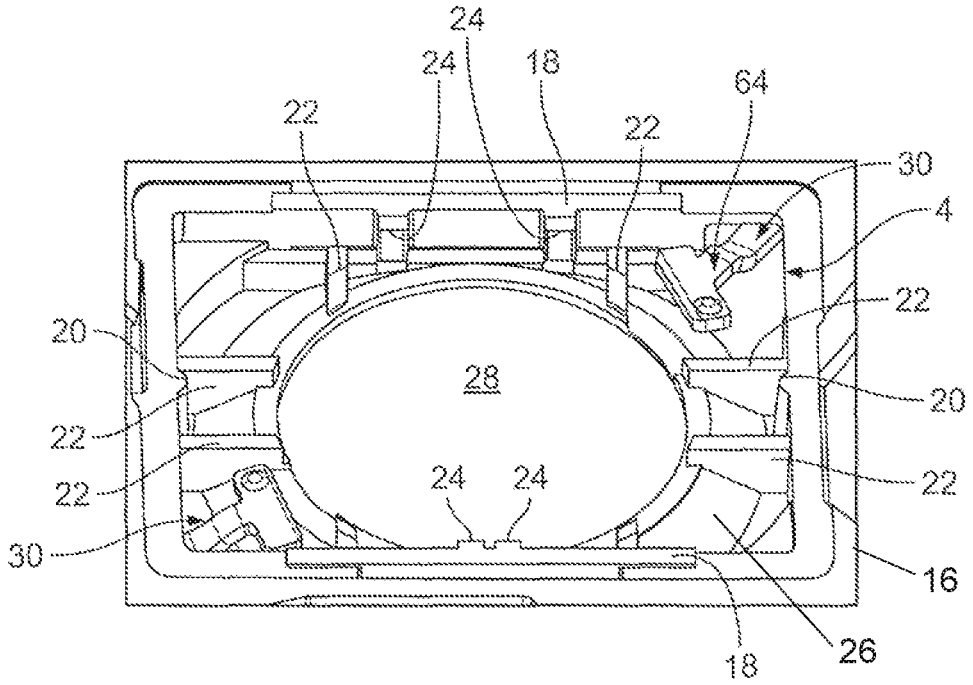
FIG. 3 is an enlarged perspective back view of the base of FIG. 2.
Figure 4:
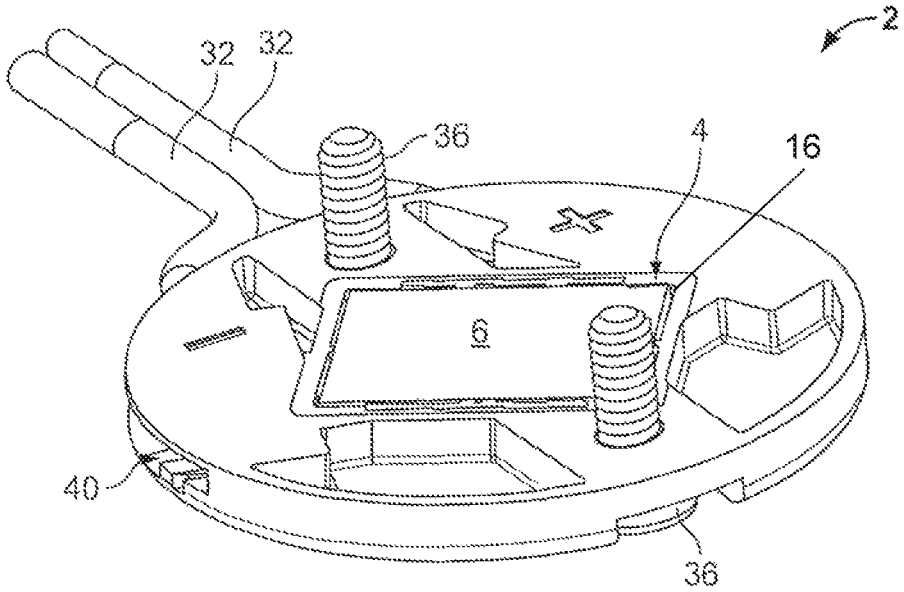
FIG. 4 is a perspective back view of the LED socket.
Figure 5:
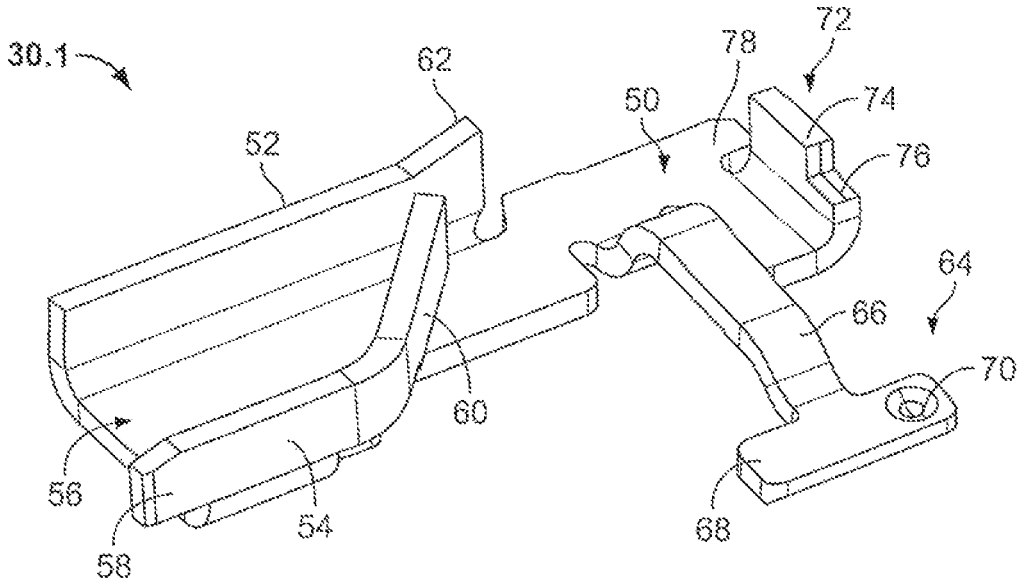
FIG. 5 is a top perspective view of a first contact of the LED socket.
Figure 6:
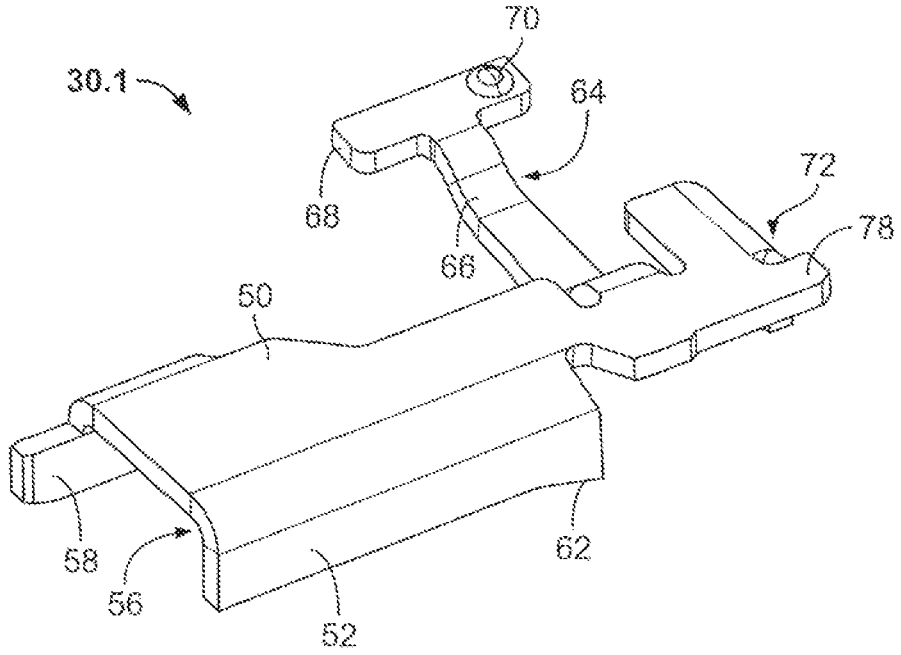
FIG. 6 is a bottom perspective view of the first contact.
Figure 7:
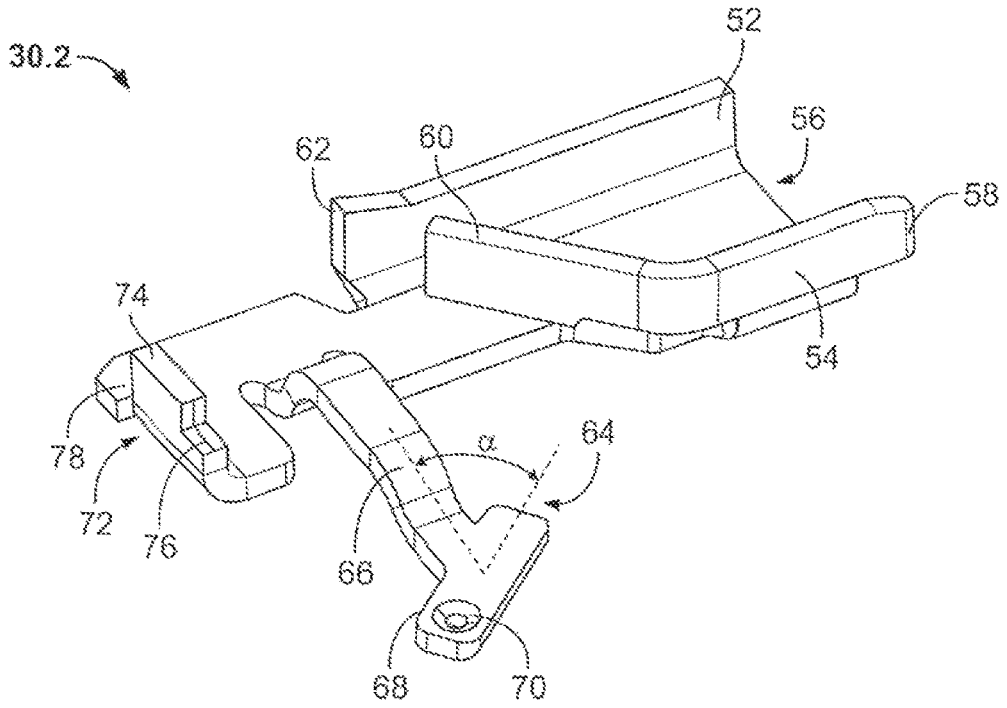
FIG. 7 is a top perspective view of a second contact of the LED socket.
Figure 8:
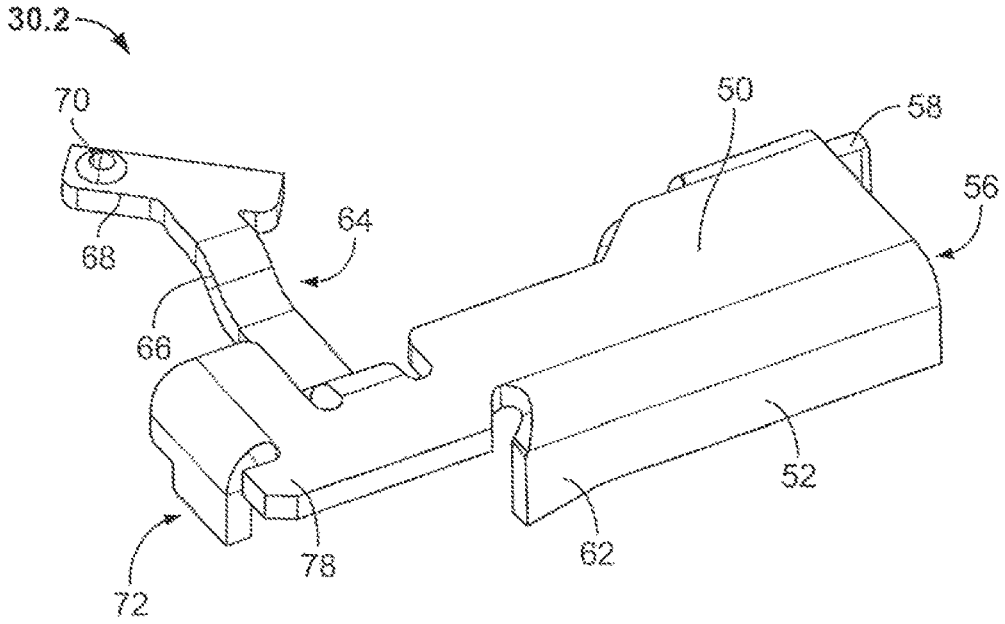
FIG. 8 is a bottom perspective view of the second contact.

The base 2, as shown in FIGS. 2-4, defines a receptacle 4 on a back side of the base 2 adapted to receive the PCB 6 of the LED package 10. As shown in FIG. 2, the receptacle 4 has a rectangular recess 16 configured to receive the LED package 10 with limited play so that the PCB 6 is centered within the rectangular recess 16 as shown in FIG. 4. In the shown embodiment, the base 2 is integrally formed in a single piece as an injection molded unitary disk-shaped element formed of an insulating material such as plastic. In an embodiment shown in FIG. 1, bolts 36 are received in bores 38 of the base 2.

As shown in FIGS. 2 and 3, clamping elements 18 are integrally molded with the base 2 in the receptacle 4 and on opposed inner side faces of the rectangular recess 16. The clamping elements 18 are adapted to be elastically compressed and cooperate with the PCB 6 for holding the PCB 6 within the rectangular recess 16. The inner side faces of the receptacle 4 extend perpendicular to the clamping elements 18. Spacing elements 20 project beyond the inner side faces of the receptacle 4. In a mounted stage, the PCB 6 is supported by ridges 22 of the base 2. The clamping elements 18 are also provided with clamping ridges 24. Accordingly, the PCB 6 is essentially received with circumferential distance to the inner side faces of the rectangular recess 16 and a bottom face 26 of the receptacle 4 surrounding an opening 28 adapted to receive the LED 8. The clamping elements 18 are to clamp the PCB 6 sideways in the course of the assembly. After the assembly, PCB 6 is arranged level with the bottom face 26.

As shown in FIGS. 1 and 2, the base 2 has a radial slot 40 for each contact 30.1, 30.2. The radial slot 40 extends radially inwardly from an outer circumferential surface of the base 2 and is adapted to receive one of the contacts 30.1, 30.2. Extending essentially perpendicular to the radial slot 40, a plurality of radial bores 42 are provided each for receiving one of a plurality of cables 32. Each radial bore 42 likewise opens to the circumferential surface of the base 2. The cables 32 each have a terminal end defined by an exposed strand 34 made by removing an insulation of the cable 32.

The contacts 30.1, 30.2 are shown in greater detail in FIGS. 5-8. Both contacts 30.1, 30.2 are made of sheet metal by cutting and bending the sheet metal. Both contacts 30.1, 30.2 have a contact base 50, which is a planar base from which outer and inner lateral walls 52, 54 project in an upper direction for defining a receiving section 56 for the cable 32. The inner lateral wall section 54 projects beyond the contact base 50 to define a locking projection 58 extending parallel to the inner and outer lateral walls 52, 54. An opposite free end of the inner lateral wall 54 is bent inwardly to define a resilient arm 60 arranged with distance above the contact base 50 to define a gap adapted to receive the strand 34; the strand 34 of the cable 32 is held between the surface of the contact base 50 and the resilient arm 60.

As shown in FIGS. 5-8, in both contacts 30.1 and 30.2, a distal end of the outer lateral wall 52 projects beyond a plane defined by end faces of the outer and inner lateral walls 52, 54 to define an oblique pressing surface 62. A highest point of this oblique pressing surface 62 is provided at the distal end of a prolongation of a bent rim forming the outer lateral wall 52.

In a direction perpendicular to an extension direction of the outer and inner lateral inner walls 52, 54, in both contacts 30.1, 30.2, a T-shaped contact section 64 projects from the contact base 50. The T-shaped contact section 64 includes a straight base section 66 extending perpendicular to the lateral walls 52, 54 and a transverse section 68. In the first contact 30.1 of FIGS. 5 and 6, the transverse section 68 is perpendicular to the straight base section 66. In the second contact 30.2 of FIGS. 7 and 8, an angle $\alpha$ between the straight base section 66 and the transverse section 68 is approximately 50°. In an embodiment, the straight base section 66 and the transverse section 68 are made by cutting and bending a piece of sheet metal of an electrically conductive material which can be coated with a silver or silver alloy coating to avoid corrosion on their surface.

As shown in FIGS. 5-8, the straight base section 66 is bent upwardly to project above a plane defined by the contact base 50. However, the sheet metal piece defining the transverse section 68 extends parallel to the extension of the contact base 50. The transverse section 68 has a dimple 70. The transverse section 68 with the dimple 70 defines a contact lug adapted to elastically cooperate with one of the pads 12, 14 for electrically connecting the contact 30 with the pad 12, 14.

As shown in FIGS. 5-8, in both contacts 30.1, 30.2, a guide rim 72 is provided at a distal end of the contact 30.1, 30.2 extending essentially parallel to the extension direction of the straight base section 66. The guide rim 72 has a higher portion 74 and a lower portion 76. A downholder section 78 is disposed at an outer distal edge of the contact base 50 at a longitudinal extension of the guide rim 72.

Insertion of the first contact 30.1 into one of the radial slots 40 is shown in FIGS. 9A-11B. Each of the contacts 30 is held in one of the radial slots 40 in a form-fitting manner.

Figure 9A:
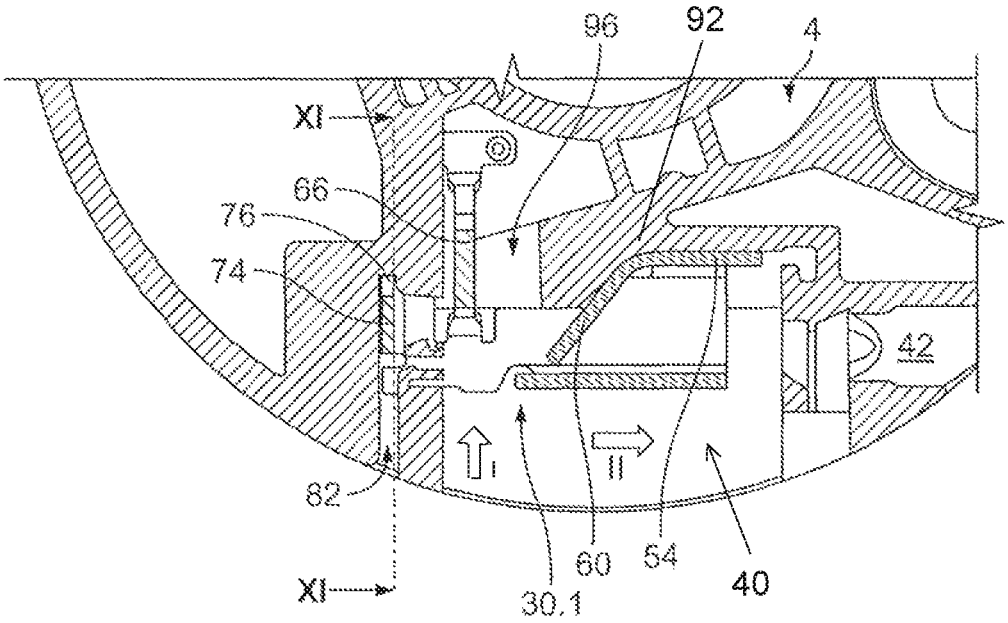
FIG. 9A is a sectional plan view of a first part of a mounting process of mounting the first contact in the base.
Figure 9B:
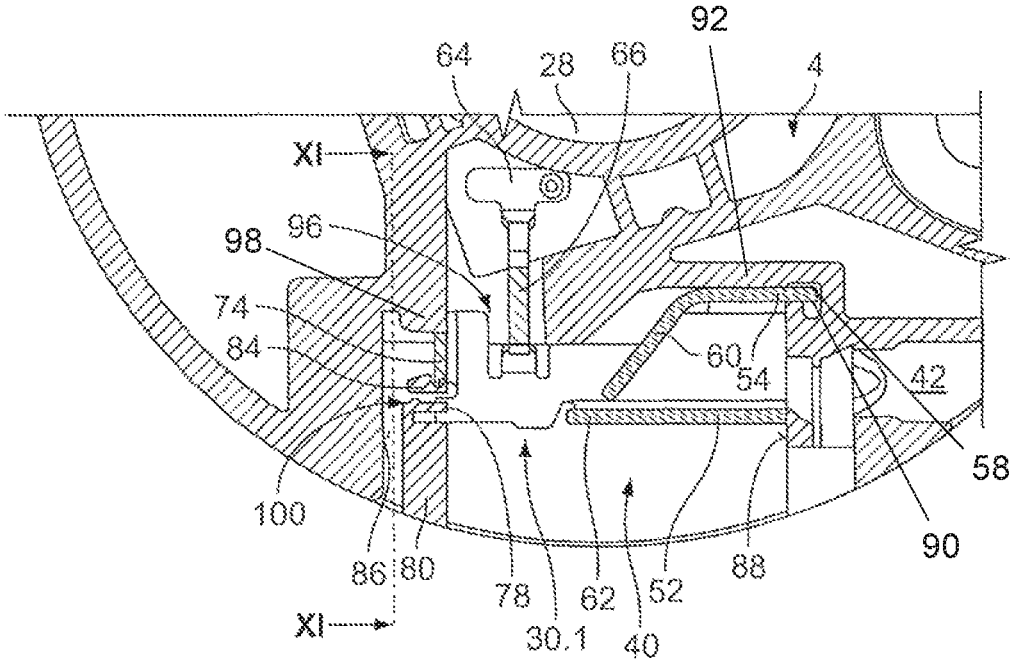
FIG. 9B is a sectional plan view of a second part of the mounting process of mounting the first contact in the base.

As shown in FIGS. 9A and 9B, the radial slot 40 extends in a radial direction I, which is the direction for inserting the contact 30 into the radial slot 40. The radial slot 40 is divided by a ridge 80 defining a narrow guide slot 82 adapted to receive the guide rim 72 and to guide the movement of the contact 30 in the radial direction I. In the radial direction I behind the ridge 80, there is a housing latch 84 adapted to receive the higher portion 74 of the guide rim 72 in the course of a movement in a second direction II perpendicular to the radial direction I.

The housing latch 84 forms part of a proximal side surface of the guide slot 82, as shown in FIGS. 9A and 9B. A portion of the base 2 disposed opposite the housing latch 84 along the guide slot 82 is a distal guide slot surface 86. The radial slot 40 has a proximal lateral side face 88, and as shown in FIGS. 9A and 9B, this lateral side face 88 has a holding notch 90 adapted to receive the locking projection 58. In the second direction II, the width of the radial slot 40, in particular the distance between the proximal side face 88 and the housing latch 84, is such that the outer lateral wall 52 and the proximal end of the contact base 50 abut against the proximal side face 88 when being moved in the second direction II as the higher portion 74 of the guide rim 72 has moved behind a locking projection of the housing latch 84 to prevent the contact 30 from moving in a direction opposite to the second direction II.

The base 2 defines a radial inward boundary surface 92 shown in FIG. 9B defining a stop for the movement of the contact 30 in the radial direction I as the higher portion 74 is aligned with a securing receptacle 94 provided by the housing latch 84, shown in FIG. 1, on one end and the locking projection 58 is aligned with the holding notch 90 on the other end. The radial slot 40 communicates with a contact channel 96 adapted to receive and guide the T-shaped contact section 64 into the receptacle 4.

For mounting the contact 30 within the base 2, the contact 30 is inserted into the radial slot 40 with the T-shaped contact section 64 aligned with the contact channel 96. In the course of this movement in the radial direction I, the guide rim 74 is guided through the guide slot 82. This movement is terminated as the contact 30 abuts against the radial inward boundary surface 92. The final insertion position obtained at this stage is shown in FIGS. 9A, 10A, and 11A.

One of the cables 32 is then inserted with the strand 34 in the gap provided between the resilient arm 60 and the upper surface of the contact base 50. Due to the cooperation of the guide rim 72 with the distal guide slot surface 86, the contact 30 is held in place. Accordingly, the strand 34 can be pressed underneath the resilient arm 60. The resilient arm 60 has at least one sharp undersurface cooperating with the strand 34 as a barbed hook having a functionality assisted by the bendability of the resilient arm 60; a strand 34 inserted into the receiving section 56 underneath the resilient arm 60 cannot be easily pulled out of the contact 30.

After the cable 32 has been secured to respective contact 30, the cable 30 is pulled in a direction opposite to the insertion direction of the cable 32. Thus, the cable 32 moves the contact 30 in the second direction II to insert the locking projection 58 into the holding notch 90 and the higher portion 74 into the securing receptacle 94 and thus behind a form fit projection of the housing latch 84. In this position, shown in FIG. 9B, the lower portion 76 of the guide rim 72 is placed underneath a downholding projection 98 provided by the base 2. Further, as shown in FIGS. 9B, 10A, and 10B, the downholder section 78 of the contact base 50 is placed below a downholding slot 100 provided next to the housing latch 84 and by a radial inward portion of the ridge 80. With this positive fit, retraction of the contact 30 opposite to the radial direction I is prevented and the contact 30 is effectively prevented from being drawn out of the radial slot 40. Movement in a direction perpendicular to this radial direction is prevented by the latch 84 and the guide rim 72 in the guide slot 82.

Figure 10A:
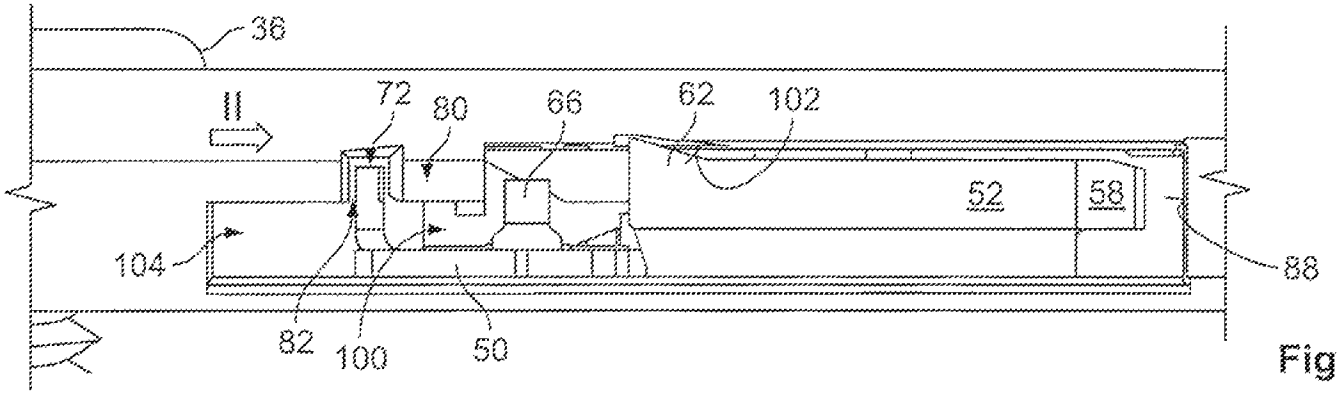
FIG. 10A is a side view of the first part of the mounting process of mounting the first contact in the base.
Figure 10B:
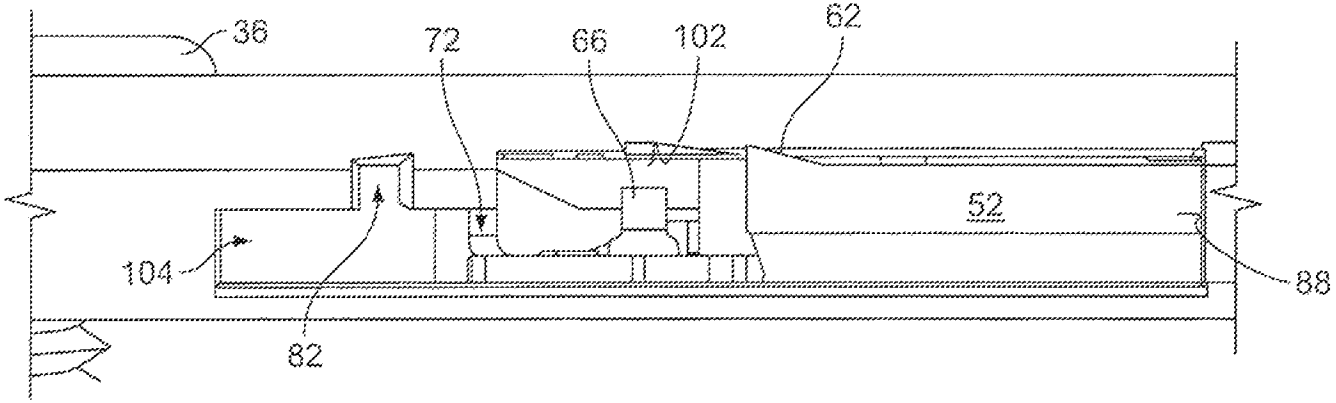
FIG. 10B is a side view of the second part of the mounting process of mounting the first contact in the base.
Figure 11A:
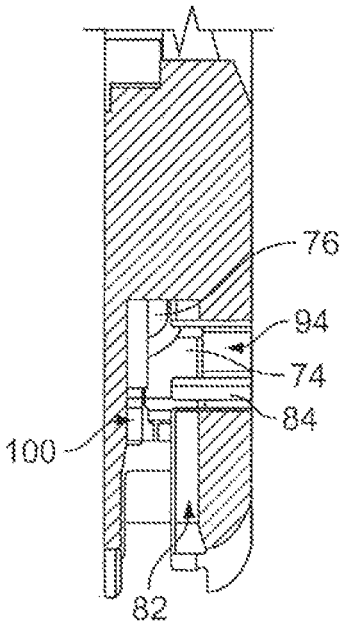
FIG. 11A is a sectional side view taken along line XI-XI of FIG. 9A.
Figure 11B:
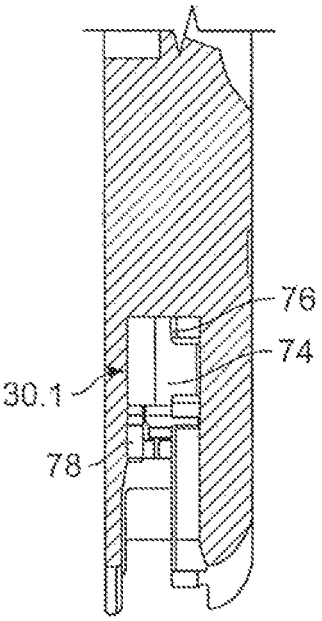
FIG. 11B is a sectional side view taken along line XI-XI of FIG. 9B.

As shown in FIGS. 10A and 10B, the oblique pressing surface 62 is pressed against an oblique counter surface 102 extending in radial direction I from the mouth of the radial slot 40 and provided by the base 2 forming part of a roof of the radial slot 40 in the course of the movement in the second radial direction II; when being moved from the position shown in FIGS. 9A, 10A, and 11A to the assembled position shown in FIGS. 9B, 10B, 11B. The contact 30 consequently abuts another support within the radial slot 40 and is firmly jammed in the radial slot 40. In this assembled position, the T-shaped contact section 64 is exposed within the receptacle 4 as shown in FIG. 3. The LED package 10 can then be mounted into the receptacle 4 to electrically connect the pads 12, 14 with the contact lugs provided by the transverse sections 68 of each contact 30.1, 30.2. With varying location and size of the pads 12, 14, the location of the dimple 70 on the transverse section 68 within the receptacle 4 may vary to provide a determined contact point for an assigned pad of another LED package 10. The housing latch 84, the holding notch 90, and the oblique counter surface 102 are thereby each a securing device of the base 2 used to connect the contact 30 to the base 2.

The LED socket described above provides a simple way of electrically connecting LED packages 10 with varying pad sizes and locations in a fairly simple and inexpensive way. All counter surfaces for guiding the movement of the contact 30 when mounting the contact 30 in the base 2 are provided by the base 2. This base 2 likewise provides all counter surfaces for securely and reliably fixing each contact 30.1 or 30.2 within the base 2. Mounting of the contacts 30 within the base 2 does not require extra fastening means which are to be connected to the base 2 and the assigned contact 30.

Figure 12:
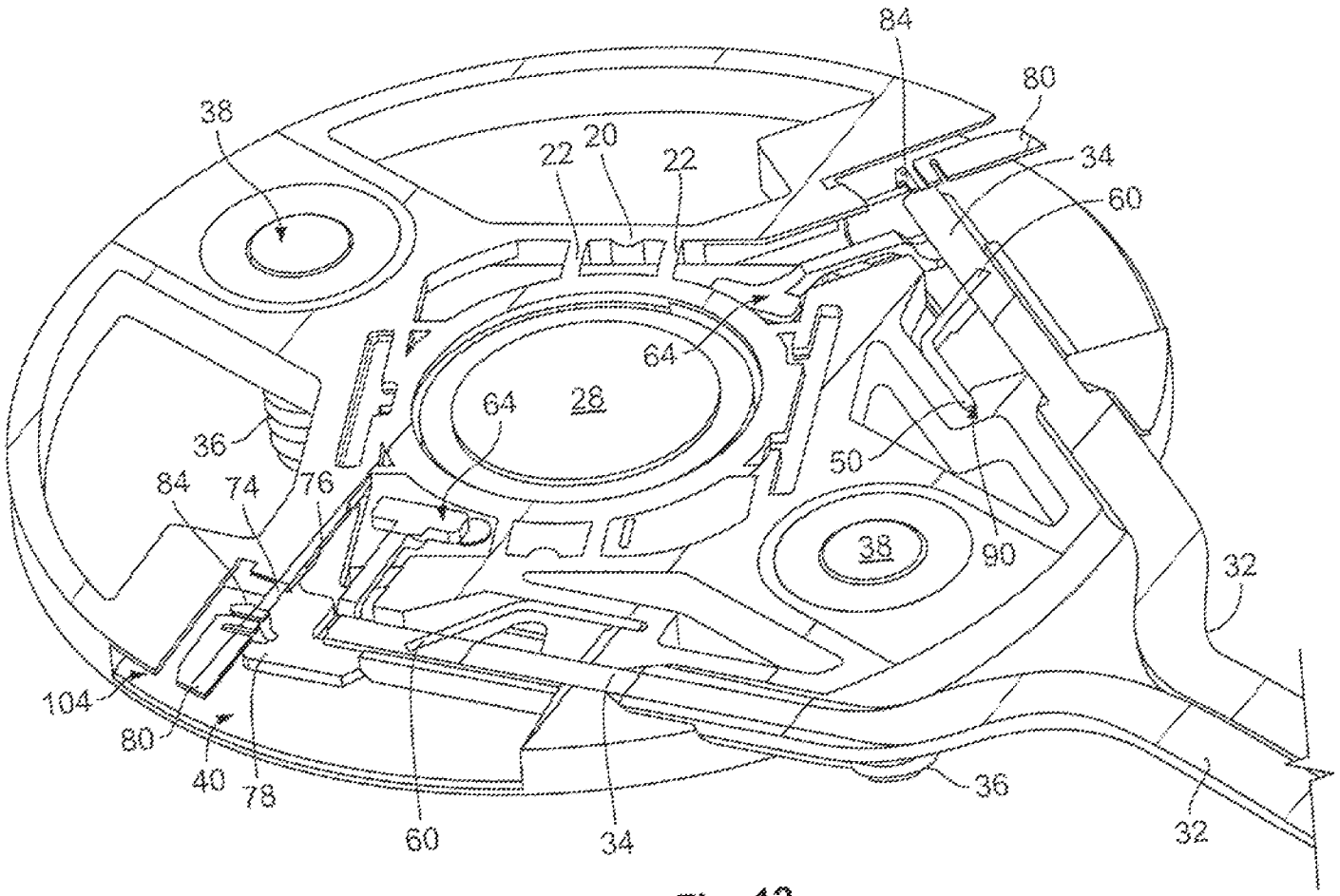
FIG. 12 is a sectional perspective view of the LED socket.

Moving of the contact 30 in the second direction II can be attained by inserting an adapted tool into a tool channel 104 shown in FIGS. 10A, 10B, and 12. The tool can push the contact 30 in the second direction II for effecting secure holding and fastening of the contact 30. The base 2 allows a simple connection of any kind of contact 30, which is adapted to contact a pad 12, 14 of a PCB 6. In other embodiments, instead of the T-shaped contact section 64, the contact lug of the contact 30 may be provided in an appropriate position within the base 2 by properly cutting and/or bending the sheet material forming the contact 30.

Figure 13:
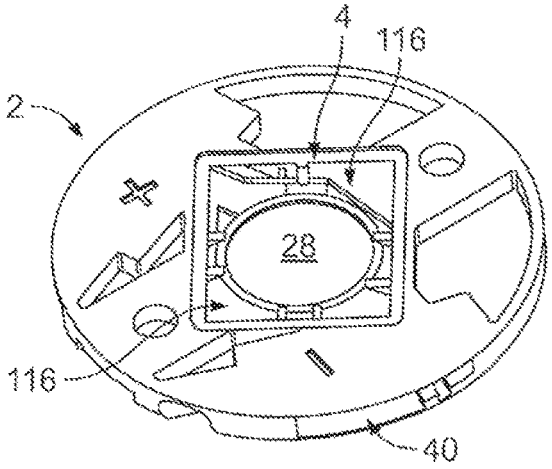
FIG. 13 is a perspective view of an LED socket according to another embodiment in a first step of using an adhesive tape.
Figure 14:
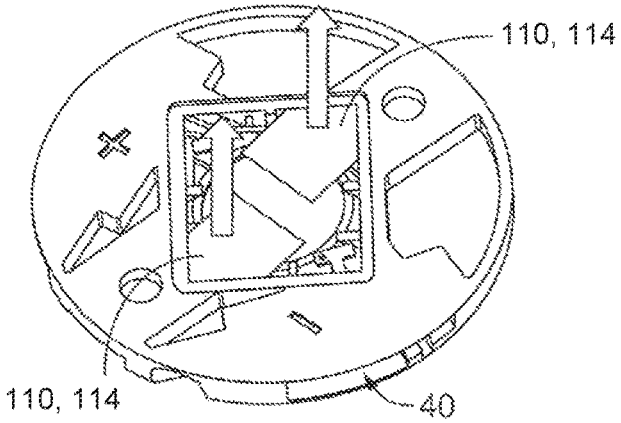
FIG. 14 is a perspective view of the LED socket of FIG. 13 in a second step of using the adhesive tape.
Figure 15:
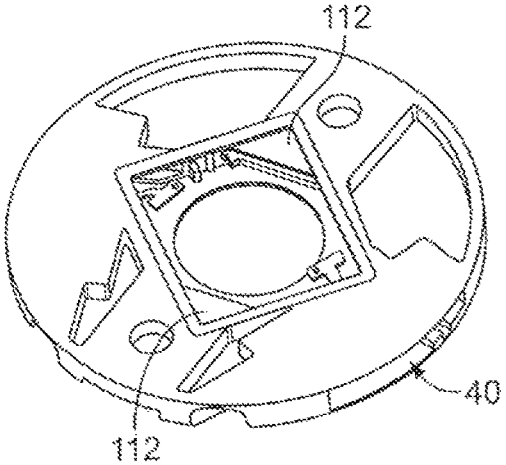
FIG. 15 is a perspective view of the LED socket of FIG. 13 in a third step of using the adhesive tape.

An LED socket according to another embodiment is shown in FIGS. 13-15. The printed circuit board 6 of the LED package 10 of the LED socket is adhered to the base 2 by an adhesive. This adhesive is provided by an adhesive tape 110 shown in FIG. 14 and comprising two opposite surfaces which are both adhesive, wherein a lower adhesive surface is attached to the base 2 and an upper adhesive surface 112 as the second adhesive surface is fixed to the LED package 10. The adhesive tape 110 is provided with protective liners 114 on both surfaces and cut as a triangle adapted to match with a corner section 116 provided by the base 2. The liner 114 is cut as a pentagon and thus has a larger surface than the adhesive tape 116. Thus, the liner 114 projects into the opening 28 when being fixed with the lower first adhesive surface to the corner section 116.

As shown in FIG. 14, two adhesive tapes 110 of identical geometry are adhered to opposite corner sections 116 with the liners 114 thereof projecting into the opening 28. Both adhesive tapes 110 are adhered with their first adhesive surface to the base 2. For mounting the LED package 10, the liners 116 are removed to expose the second adhesive surface 112 within the receptacle 10. Then, the LED package 10 is adhered to the second adhesive surface 112. In the embodiment shown in FIG. 15, the second adhesive surface 112 is adhered to the flat PCB 6 by laying the PCB 6 onto the second adhesive surface 112 and pressing the PCB 6 against the base 2.

What is claimed is:

1. An LED socket, comprising:

an LED package having an LED mounted on an LED printed circuit board;

a contact having a receiving section adapted to be connected to a terminal end of an electrical cable and a contact lug having a T-shaped contact section; and a base defining a receptacle for receiving the LED printed circuit board, the receptacle is open to an opening in the base adapted to expose the LED at a front face of the base, the base holds the contact and the T-shaped contact section is exposed in the receptacle and electrically contacts a pad of the LED printed circuit board, the contact is adapted to be inserted into a radial slot of the base in a radial direction and is moved in a second direction extending perpendicular to the radial direction within the radial slot.

2. The LED socket of claim 1, wherein the contact is held in the radial slot of the base in a form-fitting manner.

3. The LED socket of claim 1, wherein the base has a radial bore receiving the electrical cable and extending in a direction aligned with the receiving section of the contact.

4. The LED socket of claim 1, wherein the contact has a pressing surface and the base has an oblique counter surface partially defining the radial slot, the pressing surface presses against the oblique counter surface when the contact is moved in the second direction.

5. The LED socket of claim 1, wherein the base has a guide slot adapted to guide a guide rim of the contact in the radial direction.

6. The LED socket of claim 5, wherein the guide slot and the guide rim permit movement of the contact in the second direction after the contact reaches a final insertion position in which the contact abuts a boundary surface of the base.

7. The LED socket of claim 6, wherein the base has a housing latch and the contact has a higher portion cooperating with the housing latch to secure the contact in an assembled position of the contact in the base.

8. The LED socket of claim 7, wherein the housing latch defines a securing receptacle open to the guide slot and the higher portion is aligned with the securing receptacle.

9. The LED socket of claim 7, wherein the contact has a locking projection and the base has a holding notch extending in the second direction, the locking projection is aligned with the holding notch and engages the holding notch in the assembled position.

10. The LED socket of claim 9, wherein the contact has a downholder section and the base has a downholding slot receiving the downholder section in the assembled position.

11. The LED socket of claim 1, wherein the LED package is attached to the base by an adhesive tape.

12. A base of an LED socket, comprising:

a receptacle for receiving an LED printed circuit board of an LED package having an LED mounted on the LED printed circuit board;

an opening adapted to expose the LED at a front face of the base;

a securing device adapted to secure a contact in the base, the contact having a contact lug electrically contacting a pad of the LED printed circuit board;

a radial slot extending in a radial direction toward the receptacle and receiving the contact, the radial slot defines a guide slot adapted to receive a guide rim of the contact and extending in the radial direction toward the receptacle; and an oblique counter surface partially defining the radial slot and extending in the radial direction, the oblique counter surface is inclined in a second direction extending perpendicular to the radial direction.

13. The base of claim 12, wherein the base is integrally formed in a single piece by injection molding.

14. The base of claim 12, further comprising a housing latch disposed within the radial slot and defining a securing receptacle adapted to receive a higher portion of the contact in a form-fitting manner.

15. The base of claim 14, wherein the securing receptacle is open to the guide slot and defined within a ridge extending in the radial direction and defining the guide slot within the radial slot.

16. The base of claim 12, further comprising a holding notch extending in a second direction perpendicular to the radial direction and terminating in the radial slot.

17. The base of claim 12, further comprising an adhesive tape adapted to fix the LED package in the receptacle.

18. The base of claim 17, wherein the adhesive tape has a first adhesive surface fixed to the base and a second adhesive surface adapted to be fixed to the LED package and covered by a protective liner.

19. A base of an LED socket, comprising:

a receptacle for receiving an LED printed circuit board of an LED package having an LED mounted on the LED printed circuit board;

an opening adapted to expose the LED at a front face of the base;

a securing device adapted to secure a contact in the base, the contact having a contact lug electrically contacting a pad of the LED printed circuit board;

a radial slot extending in a radial direction toward the receptacle and receiving the contact; and a holding notch extending in a second direction perpendicular to the radial direction and terminating in the radial slot.

* * * * *